US011851905B2

(12) United States Patent
Niederkofler et al.

(10) Patent No.: US 11,851,905 B2
(45) Date of Patent: Dec. 26, 2023

(54) MODULAR RAILING SUITABLE FOR VARIABLE INSTALLATION SLOPES

(71) Applicant: RAILY S.R.L., Bolzano (IT)

(72) Inventors: Hannes Niederkofler, Bolzano (IT); Stefano Pederzolli, Bolzano (IT)

(73) Assignee: RAILY S.R.L., Bolzano (IT)

( * ) Notice: Subject to any disclaimer, the term of this patent is extended or adjusted under 35 U.S.C. 154(b) by 323 days.

(21) Appl. No.: 17/604,876

(22) PCT Filed: Mar. 25, 2020

(86) PCT No.: PCT/IB2020/052788

§ 371 (c)(1),
(2) Date: Oct. 19, 2021

(87) PCT Pub. No.: WO2020/217112

PCT Pub. Date: Oct. 29, 2020

(65) Prior Publication Data

US 2022/0220764 A1 Jul. 14, 2022

(30) Foreign Application Priority Data

Apr. 23, 2019 (IT) ..... 102019000006134

(51) Int. Cl.
*E04H 17/14* (2006.01)
*E04F 11/18* (2006.01)

(52) U.S. Cl.
CPC ..... *E04H 17/1439* (2013.01); *E04H 17/1456* (2021.01); *E04F 2011/1821* (2013.01); *E04H 17/1448* (2021.01)

(58) Field of Classification Search
CPC ..... E04F 11/1819; E04F 11/1923; E04F 11/1834; E04F 2011/1821;
(Continued)

(56) References Cited

U.S. PATENT DOCUMENTS 2,240,689 A * 5/1941 Denton ..... E04H 17/1413 403/393
4,923,176 A * 5/1990 Heinz ..... F16B 7/22 403/191
(Continued)

FOREIGN PATENT DOCUMENTS

CA 2376692 A1 * 9/2003 ..... E04F 11/1834
DE 202020107451 U1 * 3/2021
(Continued)

*Primary Examiner* — Jonathan P Masinick
(74) *Attorney, Agent, or Firm* — R. Ruschena, Patent Agent, LLC

(57) ABSTRACT

The present invention teaches a modular railing, in which the various modules that constitute it can be connected to each other in a simple and aesthetically homogeneous way. This modular railing provides that even the individual modules can in turn be made with interchangeable parts. All suitably standardized, so as to preserve the possibility of using, in large quantities, identical pieces.

Each module of the railing comprises: at least a support pole placed at one end of said section of railing, and suitable for being fixed to the ground, an upper horizontal bar that connects two support poles (and coupled to them near their upper end), a lower horizontal bar that connects two support poles (and coupled to them near their base), and a plurality of vertical rods that connect said two upper and lower horizontal bars.

7 Claims, 6 Drawing Sheets

(58) Field of Classification Search
CPC ..... E04F 2011/1825; E01F 13/022; E04H 17/14; E04H 17/1413; E04H 17/1417; E04H 17/1426; E04H 17/1439; E04H 17/1447; E04H 17/1448; E04H 17/1452; E04H 17/1456; E04H 17/1488; E04H 17/18; E04H 17/185
See application file for complete search history.

(56) References Cited

U.S. PATENT DOCUMENTS 6,341,764 B1 * 1/2002 Conner ..... E04H 17/1439 256/19
7,384,025 B2 * 6/2008 Lo ..... E04H 17/1439 256/65.13
8,899,555 B2 * 12/2014 Sherstad ..... E04H 17/1439 256/65.01
8,919,742 B2 * 12/2014 Williams, Sr. ..... E04H 17/1447 256/65.13
9,222,279 B2 * 12/2015 Hayter ..... E04H 17/1413
9,637,932 B2 * 5/2017 Schneider ..... E04H 17/1417
9,797,158 B2 * 10/2017 Springborn ..... E04F 11/1817
9,844,204 B2 * 12/2017 Schwartz ..... E05D 3/10
2008/0121857 A1 * 5/2008 Lo ..... E04H 17/1439 256/65.01
2013/0207062 A1 * 8/2013 Guthrie ..... E04H 17/1417 256/65.02
2014/0034890 A1 * 2/2014 Dixon ..... E04H 17/1439 256/72
2017/0089094 A1 * 3/2017 Zhu ..... E04H 17/1439
2018/0094452 A1 * 4/2018 Loucks ..... E04H 17/20

FOREIGN PATENT DOCUMENTS

EP 1357242 A1 * 10/2003 ..... E04H 17/1439
FR 3100831 A1 * 3/2021 ..... E04H 17/1413
GB 191002029 A * 1/1911

* cited by examiner

MODULAR RAILING SUITABLE FOR VARIABLE INSTALLATION SLOPES

BACKGROUND OF THE INVENTION

1. Field of the Invention

The field of application of the present invention concerns the installation of railings or parapets with the function of delimiting an area. In particular, the present invention finds its preferred application in installations that require the installation of very long railings, and which must follow variations in slope and even quite tortuous paths.

2. Brief Description of the Prior Art

The longer a railing, the more relevant the need to pay attention to the costs. Furthermore, depending on the specific cases, other aspects may also be relevant, among which, aspects of strength and solidity and aesthetic aspects. In particular, it is often required that the installed railings have a certain stylistic homogeneity, while adapting, if possible, precisely to fencing paths that may be non-straight and that may have irregular slopes.

In many cases, where a fence with pure purposes of delimiting a space is not enough, because the intent is to create a fence that lasts over time and has at least a decent appearance (or better if also a good-looking one), the current practice is to make custom-made fences.

It is clear that this current practice, which involves resorting to tailor-made products, typically on the basis of a specific project, does not facilitate significant cost containment. In fact, in a nutshell, the cost structure can be divided into three main items:

a) material costs, b) production costs of the railing, c) and installation costs of the railing Material costs constitute the item on which there is less room for maneuver although, by working on the quantities, it is also possible to act on this item. While the other two items can be optimized if it is possible to work on an industrial scale, and conceiving railings of fast and easy installation.

It is clear that the custom-made implementations, which constitute the current practice in all cases in which the installations concern irregular fence paths with slopes, do not lend themselves to massive industrial production, based on the manufacture of many identical pieces; in addition, the installation of custom-made railings frequently requires installation workers having special expertise, since frequent adaptations are required during the installation.

SUMMARY OF THE INVENTION

Therefore, the main object of the present invention is to conceive a modular railing, whose modules are adaptable to an almost universal variety of installation paths.

Furthermore, a further object of the present invention is to conceive a modular railing, in which the various modules that constitute it can be connected to each other in a simple and aesthetically homogeneous way, in other words, the junction between consecutive modules must not vary depending on the presence or absence of changes of direction or changes in slope.

Furthermore, it is desirable that the individual modules also consist of parts of simple workmanship, and which can be assembled in a simple way; in this way it is possible to make their production, storage, transport and installation really economical.

Still another object of the present invention is to conceive a modular railing, in which even the individual modules can be made with interchangeable parts. For example, rods of different shapes can be used or aesthetic effects can be created by using alternations of simple rods with special rods of particular workmanship, or else, different handrails, or different support posts can be used. However, everything must be able to be standardized in some way, so as to preserve the possibility of using, in large quantities, identical pieces, industrially realizable, in order to achieve very high economies of scale, without varying the installation techniques.

These objectives can be reached through a modular railing consisting of a plurality of modules connected to each other, in which each module is a piece of railing which includes:

- at least one supporting post located at one end of said railing module, and suitable for being fixed to the ground;
- an upper horizontal bar which connects two supporting posts, and it is coupled to said two support posts near their upper end;
- a lower horizontal bar which connects two supporting posts, and it is coupled to said two support posts near their base;
- a plurality of vertical rods which connect said upper and lower horizontal bars; and said each module is characterized in that:
- said upper horizontal bar comprises a couple of substantially constant section profiled elements, an upper profiled element and a lower profiled element, wherein
- said upper profiled element has a face facing upwards whose surface is substantially smooth,
- said lower profiled element has a face facing downward in which there are plurality of holes;
- said lower horizontal bar comprises at least one upper profiled element with a substantially constant section, which has a face facing upwards in which there are a plurality of holes;
- said plurality of vertical rods are coupled to said upper and lower horizontal bars, so that
- the upper end of each of said vertical rods is inserted into a hole present on said lower profiled element of said upper horizontal bar,
- the lower end of each of said vertical rods is inserted into a hole present on said upper profiled element of said lower horizontal bar;
- said upper horizontal bar and said lower horizontal bar are connected at their ends to said two support posts by means of a constraint which allows to provide an adjustable angle with one degree of freedom.

The main advantage of the present invention consists in the fact that a modular railing according to the teachings of the present invention satisfies all the main requirements for which it was conceived.

BRIEF DESCRIPTION OF THE DRAWINGS

Furthermore, this invention also has further advantages, which will become more evident from the following description, from some examples of practical embodiments which illustrate further details, from the attached claims which form an integral part of the present description, and from the attached figures in which:

DETAILED DESCRIPTION OF THE PREFERRED EMBODIMENTS

Figure 1A:
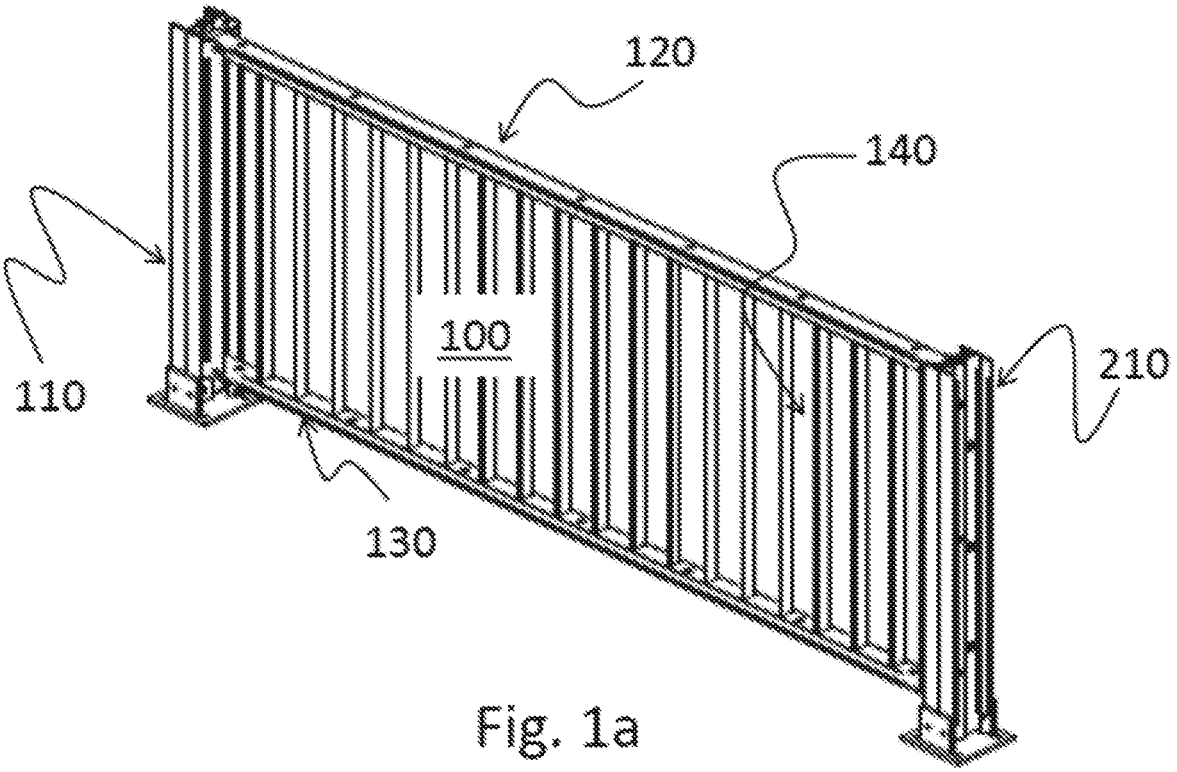
FIGS. 1*a* and 1*b* show the main elements of a railing module in an example of embodiment according to the invention.

In FIG. 1*a*, the number 100 indicates, as a whole, an example of embodiment of an adaptable railing module, made according to the invention. The main elements that constitute said adaptable module 100 of a railing are: an upper horizontal bar, indicated with the number 120, a lower horizontal bar, indicated with the number 130, a plurality of vertical rods, indicated with the number 140, which connect said upper horizontal bar 120 with said lower horizontal bar 130.

The number 110 indicates a first supporting post which has the function of supporting the two horizontal bars 120 and 130. Said horizontal bars 120 and 130 are then connected, at their other end, to a second supporting post, indicated with the number 210.

From FIG. 1*a*, it is clear that consecutive modules are connected to each other at a supporting post.

From a constructive point of view, in one of the preferred embodiments of the present invention, the supporting posts can be made so that they are mounted on site or, in any case, in a post-production phase, thus also facilitating transport and storage of the various elements that make up the railing.

At this point it should be noted that it is a purely conventional choice (adoptable only for descriptive purposes) to attribute just one supporting post to each adaptable module 100, and assume that the horizontal bars 120 and 130 are connected at one end to the supporting post 110 of the adaptable module 100 to which they belong, and in the other end to the supporting post 210 which, by convention, is assumed to belong to the next adjacent module.

As will be clarified also with the aid of the following FIGS. 2, a number of variant implementations are possible for realizing supporting posts in accordance with the purposes of the present invention, which concern with the general objective of conceiving a modular railing that allows to achieve maximum simplicity of construction and installation.

Figure 1B:
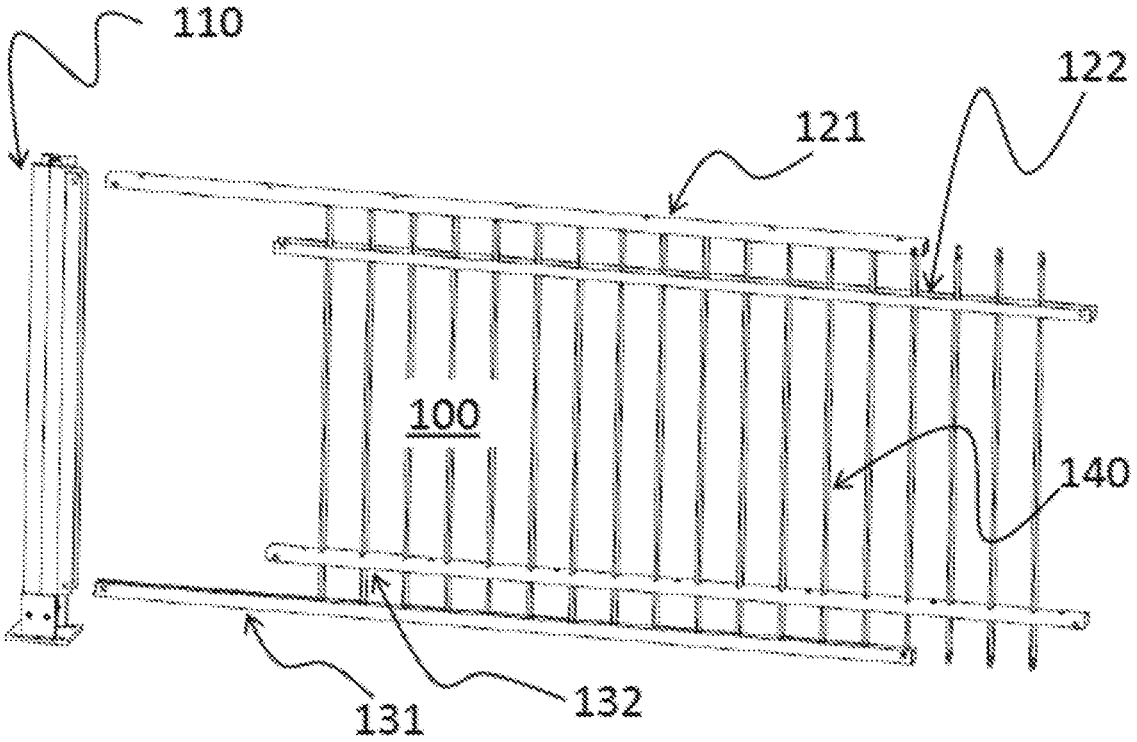

In FIG. 1*b*, an adaptable module 100 for railings according to the invention is shown; it is presented in a so-called exploded view, in which some individual parts that compose it are shown separate from each other.

The upper horizontal bar, which in FIG. 1*a* is shown as a single body, in the so-called exploded view is decomposed into at least two profiled elements: an upper element, indicated with the number 121, and a lower element indicated with the number 122. Said upper element 121 of the upper horizontal bar is placed right on top of the vertical rods, indicated with the number 140 as in FIG. 1*a*, and it is typically smooth, as it can often act as a handrail for the railing. Said lower element 122 of the upper horizontal bar is instead crossed by the vertical rods 140. As will be better highlighted in the following figures, said lower element 122 of the upper horizontal bar must therefore have slots, inside which the vertical rods 140 penetrate. In this way, said vertical rods 140 are blocked, in their upper end by the upper horizontal bar; in that they are retained by said upper element 121 which prevents them from slipping off from above, while they are blocked with respect to lateral movements since they are inserted in the slots present in said lower element 122 of the upper horizontal bar. The sliding downwards, as will be better clarified below, is instead prevented by the presence of the lower horizontal bar.

In fact, the lower horizontal bar is also typically composed of two elements. In particular, in FIG. 1*b*, the number 132 indicates an upper element of the lower horizontal bar which is crossed (like the lower element 122 of the upper horizontal bar) by the vertical rods 140; while the number 131 indicates a lower element of the lower horizontal bar, on which the lower ends of the vertical rods 140 rest. One function of said lower element 131 of the lower horizontal bar is precisely to support the vertical rods 140 preventing their sliding downwards. The function of the upper element 132 of the lower horizontal bar (similarly to the case of the lower element 122 of the upper horizontal bar) is that of opposing to lateral movements of the vertical rods 140, the lower end of which is inserted in suitable slots present in the element 132, exactly as in the case of element 122.

It is noted that, in a simplified variant of an adaptable module 100 for railings according to the invention, said lower element 131 of the lower horizontal bar 130 is not strictly necessary to support the vertical rods 140, which could also be supported by means of an appropriate variation of their section, smaller in their lower end, which allows the latter to slip into the slots of the upper element 132 just for a small stretch.

A similar variant can be theoretically conceived also as regards the upper horizontal bar 120, even if, in this case, the presence of the upper element 121 is however desirable, if not to block the upward sliding of the vertical rods 140, at least to act as a handrail.

Ultimately, it is observed that, using only profiled elements, i.e. elements that allow very inexpensive industrial manufacturing processes, it is possible to compose a railing segment in which there are no welds or rigid fixings between the vertical and horizontal elements. In fact, the vertical rods are simply fixed by inserting them into suitable slots made on some horizontal elements. This type of coupling allows the vertical rods 140 to form a variable angle both with the upper horizontal bar 120 and with the lower bar 130. This method of mounting the vertical rods 140 and the lower and upper horizontal bars, 120 and 130, allows the module adaptable 100 to be installed both in a horizontal plane and on a slope. In this regard, it is noted that the amplitude of variation of the angle that the vertical rods 140 can form with the two horizontal bars is sufficient to adapt almost to all the slopes that can realistically be foreseen in real practical cases.

FIGS. 1 (1*a* and 1*b*) also show some details of the supporting posts 110 and 210: said supporting posts can however be made in many different ways, and all consistent with the objectives of the invention. Some typical features for making supporting posts according to the teachings of the invention are illustrated with the help of FIGS. 2 (2*a*, 2*b* and 2*c*).

Figure 2A:
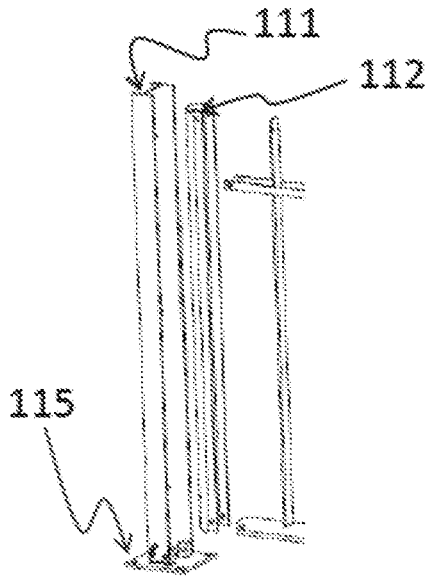
FIGS. 2*a* and 2*b* show examples of embodiments of a support pole for a railing according to the invention, in which some component parts are highlighted.

FIG. 2*a* shows a preferred embodiment of a supporting post 110 for a railing made according to the teachings of the present invention, in which the vertical longitudinal body of the supporting posts is shown with some of its component elements separate each other (i.e. FIG. 2*a* shows a so-called exploded view of a supporting post 110).

In the example of embodiment of FIG. 2*a*, the vertical longitudinal body of the supporting posts is made with two distinct profiled elements that are coupled to form a single body. Each of said profiled elements is designed to be connected with the horizontal bars of two different adaptable modules 100 to be installed one attached to the other (i.e. two consecutive modules). In this case, it is possible to adopt a different convention to define the individual modules, and assume, always conventionally, that each adaptable module includes a part of the supporting post at both its ends; so that the junction between consecutive modules occurs by coupling together the elements of the supporting post, which are each connected to a different module of the railing.

In any case, regardless of how the boundary of each individual adaptable module 100 is defined, the individual modules are also composed of standardized elements.

It is desirable that few elements are defined (which can also be optimized in terms of simplicity of manufacture), with which to create all the modular railings according to the invention. This is in order to maximize the advantages obtainable through the economies of scale.

In particular, in FIG. 2*a*, the exploded view shows that also the supporting post 110, in turn, is composed of various elements, including two longitudinal profiled elements: an external element, indicated with the number 111 and an internal element, indicated with the number 112, arranged to hook with the two upper and lower horizontal bars, and suitable for coupling with said external element 111. Said external element 111 is fixed to the ground by means of a ground fixing element, indicated with the number 115 and, in one embodiment, it can be arranged to engage with the two horizontal bars, top and bottom, of the adjoining module.

The embodiment proposed in FIG. 2*a* (and in general in FIG. 2) provides that the hooks between the upper and lower horizontal bars and the supporting post 110 allow to adjust the fixing angle with a degree of freedom in order to adapt the module to the possible slope of the railing installation plan. It is observed that numerous types of coupling are possible which support angular adjustment with a degree of freedom, and these types of coupling are generally much simpler than hooks in which two degrees of freedom are required. This aspect must also be considered as a functional feature for achieving the requirement of the invention, which envisages the creation of a simple system and which does not require the use of potentially expensive components, such as for example a constraint element with two degrees of freedom.

However, it is also observed that, a railing that aims to be truly adaptable to a wide variety of cases, it is not enough that it is suitable for adapting to slopes, it must also adapt to the creation of fences that follow non-straight paths. The adaptation to non-straight paths, is ensured by the coupling between the two longitudinal profiled elements that make up the supporting post, i.e., in the example of FIG. 1*a*, the elements 111 and 112. In fact, each of said longitudinal profiled elements 111 and 112 is connected to the horizontal bars of two consecutive modules, and these connections between the horizontal bars and the longitudinal elements of the supporting post don't allow to adjust the angle appreciable in plan (as said, this connection allows only one degree of freedom adjustment to follow the slope variations). Therefore, the angle appreciable in plan between two consecutive modules, the adjustment of which is necessary to follow changes in the direction of the fence, is adjusted by suitably coupling the internal longitudinal element 112 to the external longitudinal element 111 of said supporting post 110. FIG. 2*c* shows an example of coupling between said two internal and external longitudinal elements (111 and 112), in the enlarged detail of FIG. 2*c* it is seen that the internal longitudinal element 112 has an arched profile, and therefore it can be coupled with the outer element 111 assuming different angles, before being locked in the desired position.

Figure 2B:
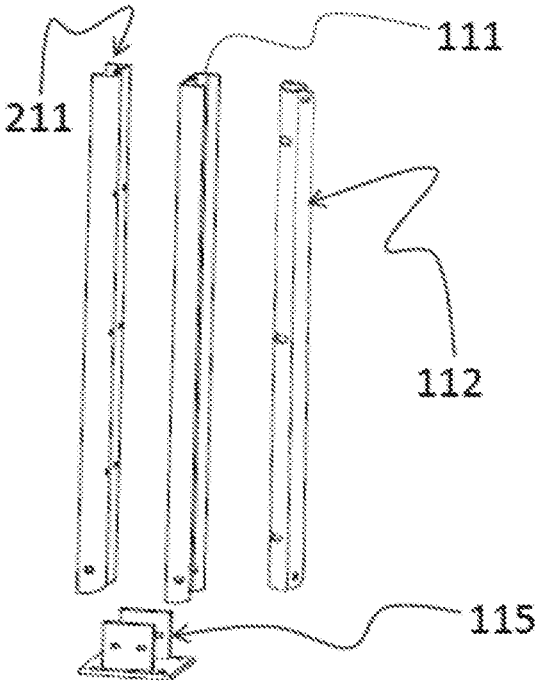
Figure 2C:
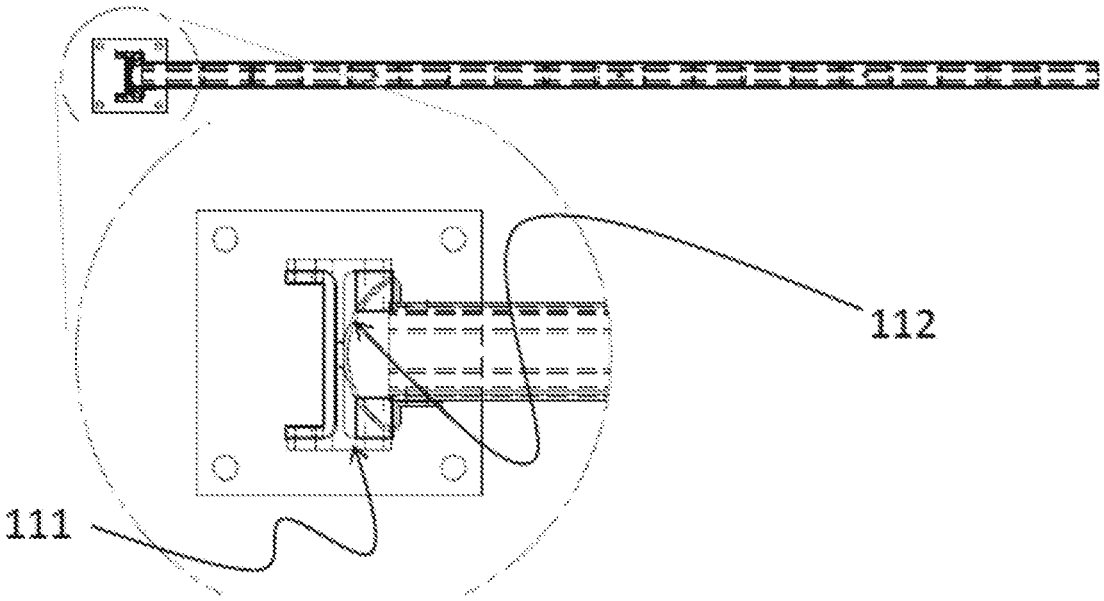
FIG. 2*c* shows, in a plan view, another example of embodiment in which a detail of the support poles of a railing according to the invention is highlighted.

FIG. 2*b* shows a further construction variant of a supporting post for a modular railing according to the invention. In the embodiment of FIG. 2*b*, the external element 111 is not expected to hook directly to the horizontal bars of the adjoining module; it acts only as support for the internal element 112 (and consequently of the horizontal bars connected to it) and it is fixed to the ground by means of the fixing element 115. In this embodiment, shown in FIG. 2*b*, the adjacent module must obviously be complete of its own external element, indicated in the figure by the number 211, which, in turn, will be coupled with an internal element of the adjacent module, and so on.

In the embodiment of FIG. 2*b*, the final supporting post, which is formed between two consecutive connected modules, ends up being composed of four vertical profiled elements: two internal elements, hooked to the horizontal bars of the respective modules, and two external elements, suitably coupled with their respective internal elements. These external elements are fixed to the ground and placed next to each other, possibly coupled, for example with screws, or with one or more coupling forks. This form of implementation provides for a greater number of elements (but not a greater number of types of elements, since these are the same two by two): in this respect, the solution is potentially more expensive due to the use of a greater number of elements; however the external elements 111 and 211 can be made with thinner profiles, as the robustness of the supporting post as a whole benefits from the union of all four elements, which, in the installed post, form a single body. Furthermore, the embodiment of FIG. 2*b* has a further advantage, in that it allows to better finish the connection of the upper horizontal bars which, for example, can be connected in continuity, forming a continuous handrail which also slides over the support poles. This is possible because the two external elements 111 and 211, when fixed to the ground, will be vertically staggered, according to the slope of the installation plane, and their upper tops will provide a support with a slope that reproduces that of the ground where they are fixed, which must be maintained by the handrail too.

FIG. 2*c*, in addition to showing an example of coupling between the longitudinal elements 111 and 112 in which it is possible to adjust the angle appreciable in the plan, allows to highlight a further method of composition of a supporting post for a railing according to the invention. The so-called external element 111, in the example of FIG. 2*c* has approximately an "H" section. This symmetrical shape allows said element 111 to accommodate the coupling with a pair of internal elements 112 on both sides, so that the installed support pole would be composed of three longitudinal elements joined together: two internal elements hooked to the horizontal bars of two contiguous modules, and an external element that mates to both of these internal modules.

Ultimately, each module 100 of the adaptable modular railing, made according to the teachings of the invention, can be composed, almost entirely, with profiled elements (therefore, potentially, low cost elements) connected together with very simple constraints that do not require the interposition of joining elements to make the adjustments with the required degrees of freedom.

Therefore, the embodiments described with the help of FIGS. 1 and 2, although being only examples of construction, susceptible of numerous variations, demonstrate how it is possible to propose a modular railing adaptable to a wide range of fence paths.

And for the construction of this fence, only a limited number of types of identical elements can be used, achievable with industrial scale economies (without resorting to any custom-made element) and adopting very efficient industrial processes such as the manufacture of profiled elements.

It is worth underlining, at this point, how the modular railing according to the teachings of the present invention is very simple to be assembled; therefore, various supply methods may be envisaged for installation. The individual modules can be pre-assembled (totally or partially), so that the installation provides only to fix them to the ground and to each other (with few other finishing operations), or a supply can be provided in which the assembly of the modules themselves must be carried out on site.

It is evident that a preventive pre-assembly speeds up the installation operations, while the assembly on site allows the packaging to be made more compact, and the supply logistics simpler. What is important to underline is that the modular railing according to the teachings of the present invention lends itself to making significant optimizations to the entire industrial process: from the construction of the railing in the factory to its installation, until the finished work.

Figure 3:
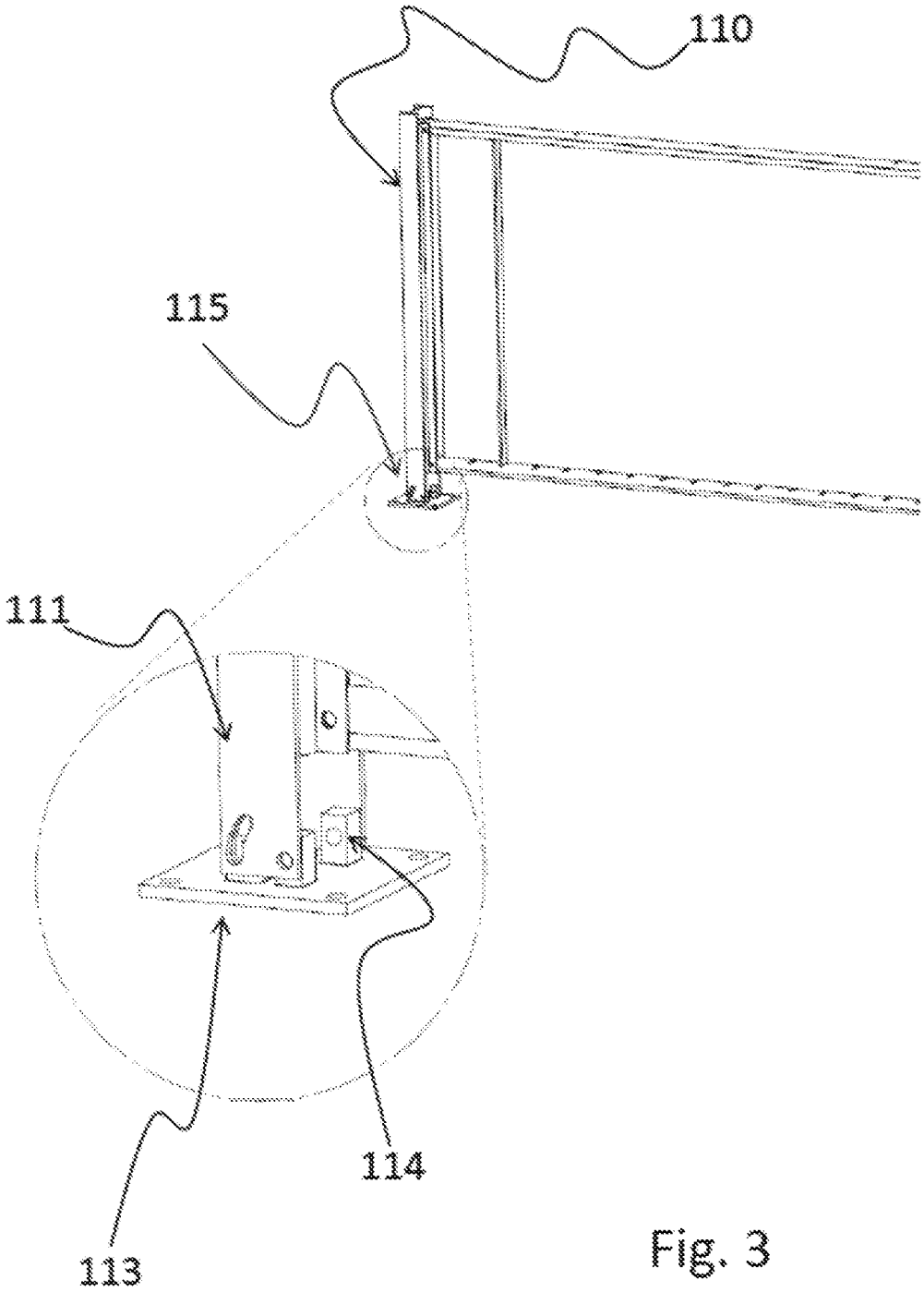
FIG. 3 shows an example of embodiment, in which some details are highlighted regarding the fixing to the ground of the support poles of a railing according to the invention.

FIG. 3 shows a further detail of an adaptable module 100 of a modular railing according to the invention: the detail concerns the fixing element on the ground of a supporting post, indicated again with the number 110.

As already repeatedly said, these supporting posts 110 must be capable of being installed on floors of various slopes, and their fixing to the ground can be achieved in many ways; the way shown in FIG. 3 involves the use of a ground fixing element, as usual indicated with the number 115 (shown in enlargement in the figure). Said ground fixing element 115 comprises a plate, indicated with the number 113, to be fixed to the ground, for example by means of screws.

Furthermore, on the upper part of said plate 113 there are protruding elements, indicated with the number 114, arranged to bolt the base of the longitudinal profiled element 111 (i.e. the so-called external longitudinal element of the supporting post 110), so as to being able to adjust the fixing angle to maintain the verticality of the supporting post 110. Ground fixing by bolting is a very typical fixing method for supporting posts; obviously this is not a detail that confers inventive level to the invention, but is mentioned in the present description for completeness reasons, and to highlight how also the ground fixing can be performed with simple elements, in line with the aims of the invention.

Figure 4A:
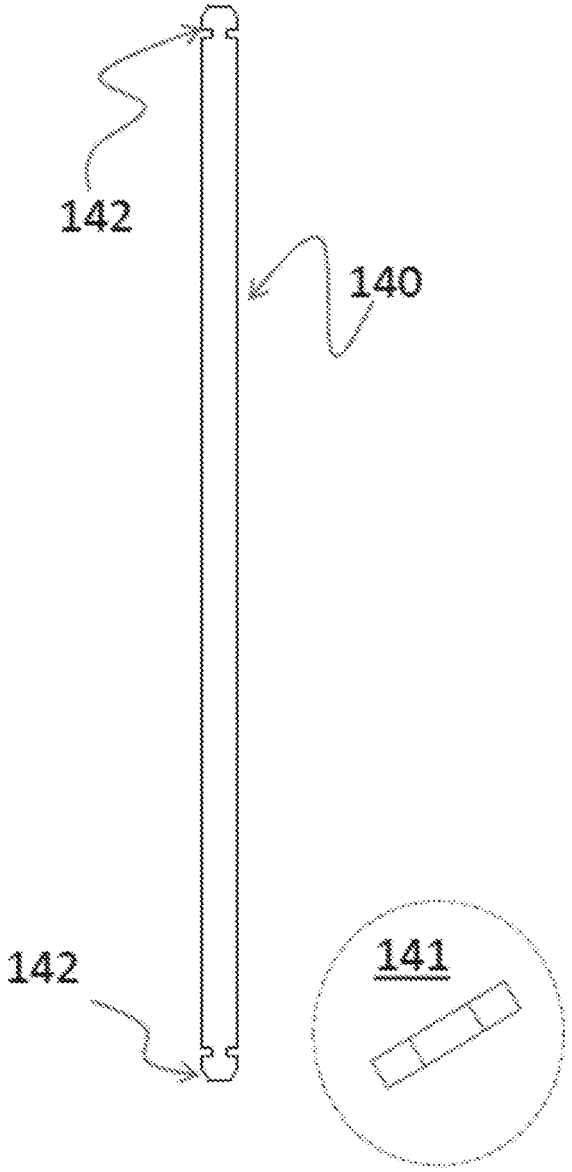
FIGS. 4*a* and 4*b* show some examples of embodiment of the vertical rods of a railing according to the invention.
Figure 4B:
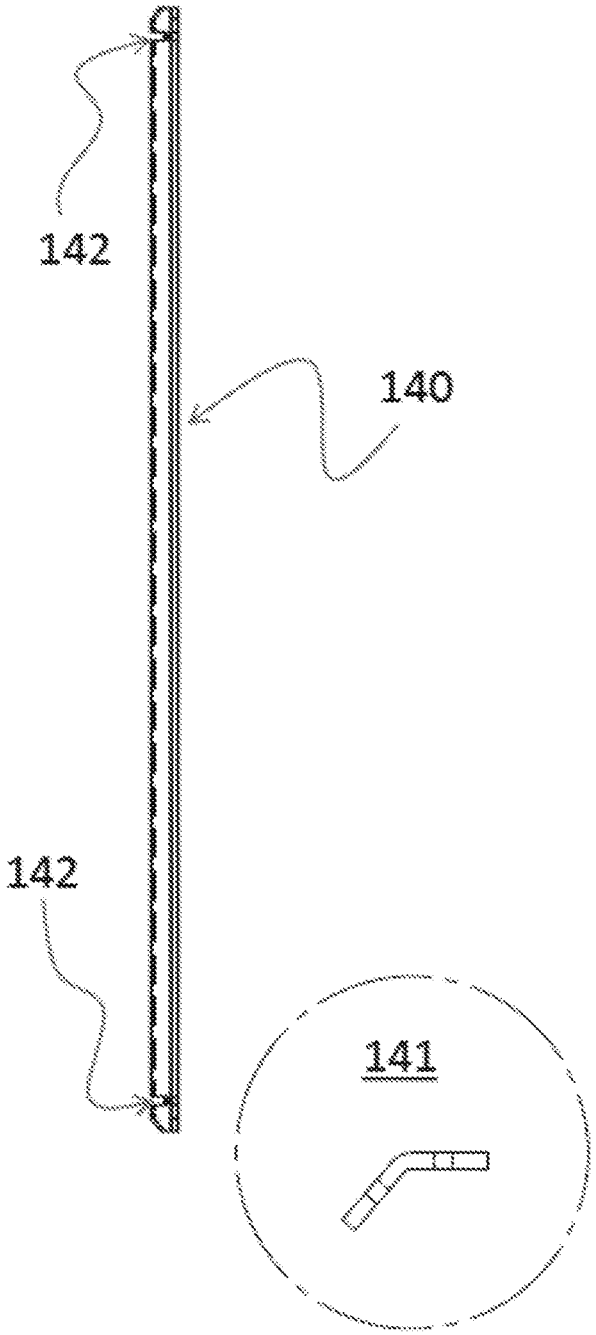

FIG. 4*a*, and FIG. 4*b* show in more detail the vertical rods indicated, as in the previous figures, with the number 140: how they can be made absolutely simply, starting from a profiled element, and how they are also susceptible to different variants which are equivalent for the implementation of the invention.

FIG. 4*a* shows a very simple rod 140, which consists of a flat bar; as shown in the section view represented inside the circle indicated by the number 141, the section of this rod 140 has a shape whose size corresponding to the width of the rod 140 is of the order of a few centimeters, while the size, corresponding to the thickness of the rod 140, is of the order of millimeters. This shape of the section of the bar 140, in the embodiment proposed in FIG. 4*a*, is suitable for being inserted into slots of the same shape practiced in the upper horizontal bars and lower, just slightly wider so as not to have to resort to forcing to insert the rod 140.

FIG. 4*a* shows a further detail concerning the ends, indicated with the number 142, of the vertical rod 140. It is a pair of small notches made on both ends 142 of the rod, and a slightly pointed shape of the same ends 142. These details are not strictly necessary, they are reported by way of example, and can be obtained with a decidedly modest manufacturing effort. These are very simple details that can lead to advantages in the assembly stages of the adaptable module 100 as a whole. For example, they facilitate the maneuver to insert the rods 140 in the appropriate slots made in the elements of the horizontal bars 120 and 130, and allow to implement eventual stronger locking measures of the bars 140, once mounted, for example by fitting the notches with other elements of the lower and upper horizontal bars.

FIG. 4*b* is very similar to FIG. 4*a*, and the numbers indicate the same things indicated in FIG. 4*a*: the number 140 indicates the vertical rod as a whole, the number 142 indicates the two ends of said rod 140, and the number 141 indicates a circle inside which the section of the rod 140 is shown. The particularity of the rod 140 shown in FIG. 4*b* lies precisely in its section which is not flat as in the case of the rod shown in FIG. 4*a*. In addition to providing an example of a variant of the rod 140, the shape of the rods 140 with a profile with a non-flat section (obviously profiles of another non-flat shape are also possible) can have an important advantage in that it gives greater rigidity to the bending, and therefore rods with a lower thickness can be used, with consequent savings on material costs.

Figure 5A:
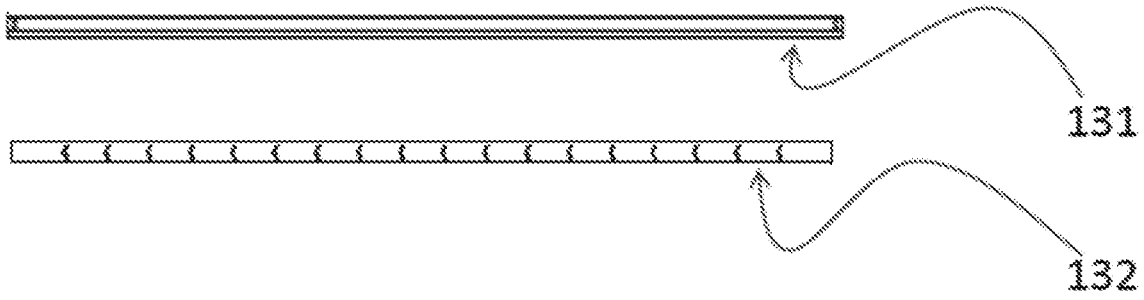
FIGS. 5*a*, 5*b*, 5*c* and 5*d* show examples of embodiment of the horizontal bars (upper and lower) of a module of a railing according to the invention.
Figure 5B:
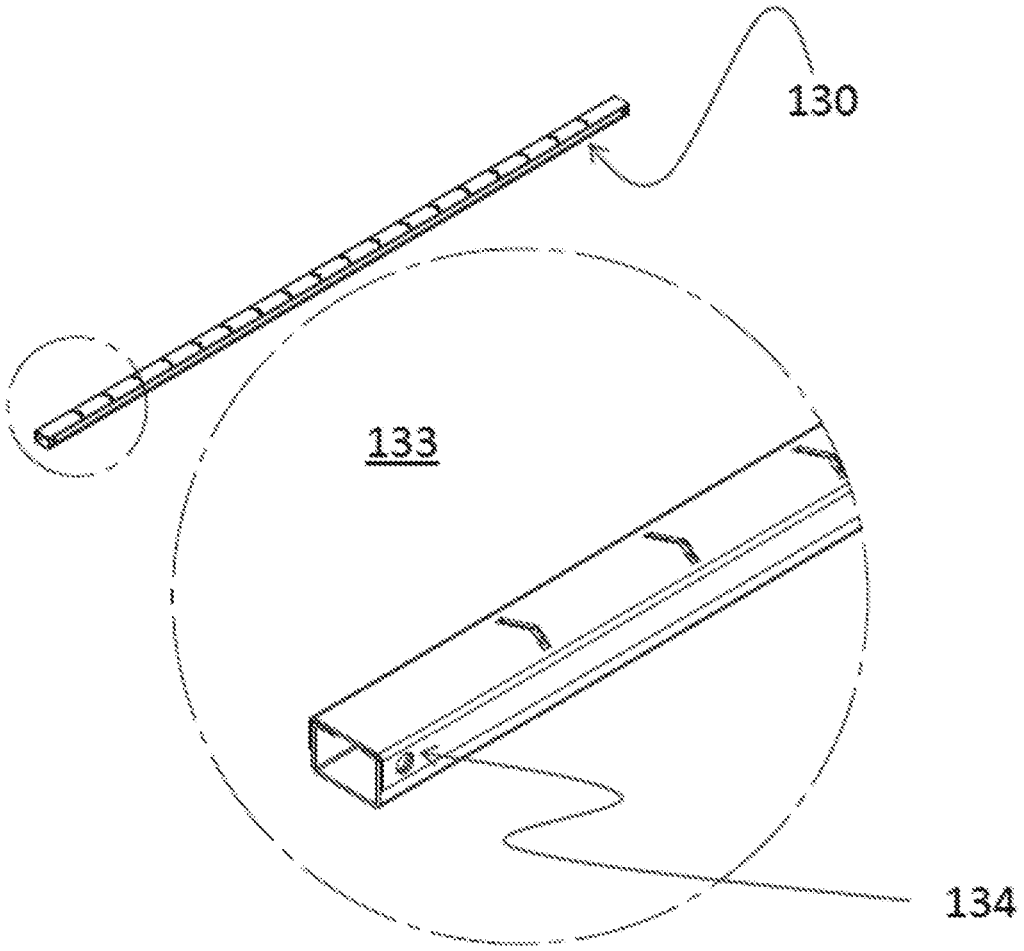

FIGS. 5*a* and 5*b* are dedicated to horizontal bars, in particular they show a lower horizontal bar, indicated in FIG. 5*b* with the number 130. It is observed that, "mutatis mutandis", a similar representation can also be used to describe the upper horizontal bar.

FIG. 5*a* shows the two elements that make up the lower horizontal bar 130 in a typical implementation example (the same form of implementation shown in FIG. 1): a lower element, indicated with the number 131, and an upper element, indicated with the number 132, in which the slots intended to house the vertical rods 140 are clearly visible. The two elements 131 and 132 are then joined, as shown in FIG. 5*b* to form a single body consisting of the essential structure of the lower horizontal bar 130.

Inside the circle, indicated with the number 133, an enlargement of one end of the lower horizontal bar 130 is shown when the two elements 131 and 132 are coupled together. Said lower horizontal bar 130 looks like a tubular element, internally hollow, with a series of substantially equally spaced slots facing upwards, so that, when the vertical rods 140 are inserted inside, the end of the latter remains housed at the inside the horizontal bar 130.

The enlargement proposed in the circle 133 also highlights a hole, indicated with the number 134 placed at the end of the horizontal bar 130. Said hole 134, in the embodiment considered in FIG. 5*b*, is designed to bolt the horizontal bar 130 to a vertical element of the supporting post so as to be able to adjust, as already widely explained, the vertical angle between the supporting post and the horizontal bar 130.

The other FIGS. 5 (5*c* and 5*d*) are also dedicated to the horizontal bars and, as in the case of FIGS. 5*a* and 5*b*, show a lower horizontal bar and, "mutatis mutandis", the following description can be similarly intended also about the upper horizontal bar.

First, it is observed that when the two lower and upper elements 131 and 132 are coupled, they give rise to an internally hollow single body. The internal cavity of this lower horizontal bar can be used to insert other filling elements, with the function of keeping the vertical rods 140 stationary which, due to the tolerance between the rods and the slots could be subjected to undesired vibrations. In fact, vibrations could be transmitted from the ground (for example in the railings installed at the edge of a road) or determined by the wind (since these are railings installed outdoors).

These filling elements can be made of materials similar to those of the elements 131 and 132, or even with materials which do not offer particular mechanical strength, such as for example plastic or rubbery materials, or other types of materials.

Figure 5C:
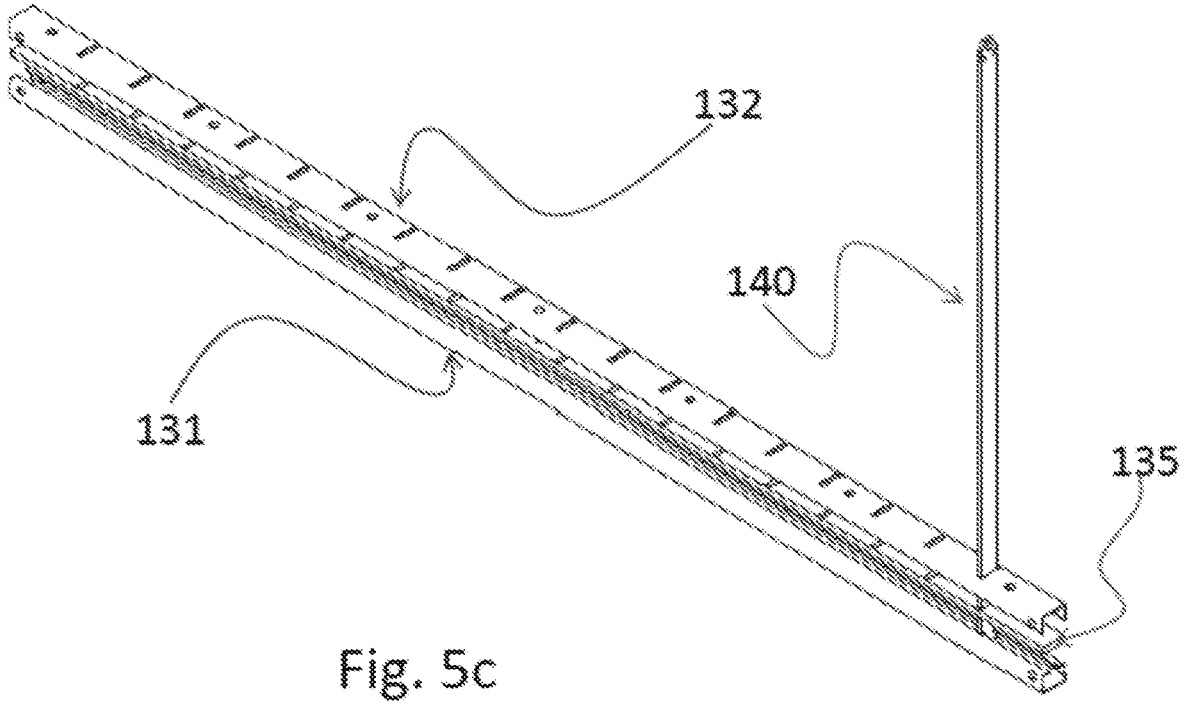
Figure 5D:
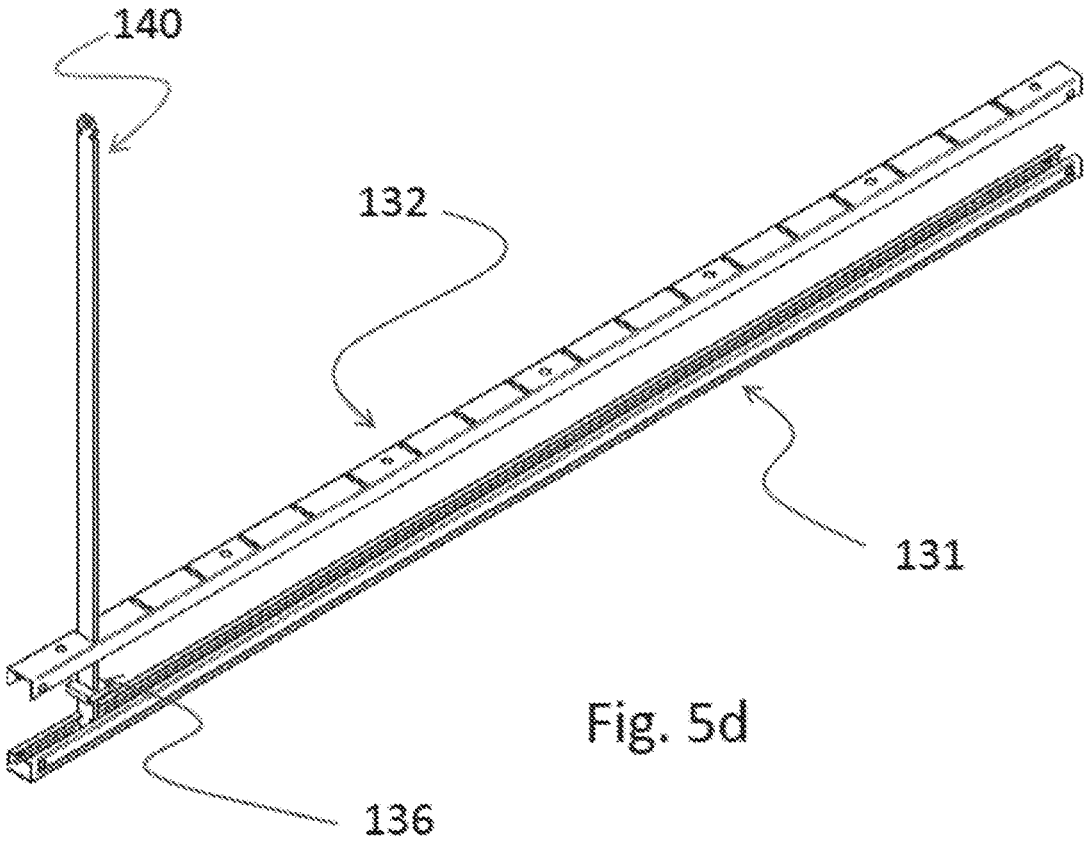

The embodiments presented in FIGS. 5*c* and 5*d* show a lower horizontal bar broken down into its lower and upper elements, indicated in both Figures always with the numbers 131 and 132, and a vertical rod 140 inserted in the upper element 132, as an example. It can be observed that between the lower element 131 and the upper element 132 of the lower horizontal bar there is a further longitudinal filling element, indicated with the number 135. Said filling element 135, in one of the simplest embodiments, is a strip of rubber, or other deformable material. In this way, when the lower and upper elements 131 and 132 are coupled, said filling element 135, compresses the end of the vertical rod 140, keeping it steady and cushioning any vibrations (effectively canceling them). In the variant shown in FIG. 5*c*, the filling element 135 also has slots suitable for accommodating the ends of the rods 140; in any case, the mechanical characteristics of the filling element 135 are suited to act as a damper, capable of absorbing any vibrations that could affect the rods 140.

FIG. 5*d* shows a variant of the solution shown in FIG. 5*c*. The longitudinal element 135 is replaced by a smaller cushioning element, indicated by the number 136. In the embodiment shown in FIG. 5*d*, therefore, the cushioning element 136 must be applied to the end of each vertical rod 140 (obviously after the rod 140 has been inserted into the slot of the upper element 132), the effect of all the cushioning elements 136, applied on each vertical rod 140, will be similar to that produced by the filling element 135 shown in FIG. 5*c*.

After reviewing the main building blocks of a modular railing according to the invention, it is easy to conclude that it largely meets all the scopes for which it was conceived. In fact, it has been seen that all the constituent elements are of very simple workmanship: in fact, few types of profiled elements are used, and each type is made of equal elements to or attributable to a few models, just to vary the aesthetic rendering. For example, some variants of vertical rods, or few variants of handrails or supporting posts can be conceived.

Even the requirement to have a "railing system" in which the aesthetic aspect is sufficiently cared for, is therefore adequately satisfied by the solutions taught in the proposed invention.

Another aspect of great importance consists in the fact that no custom-made parts are required: this is possible since the modules adapt to any type of terrain and fence path. At most, it may be necessary to cut the horizontal bars of the terminal modules, to accurately adjust the overall length of the railing, but this is such a simple operation that it can be certainly performed on site, without causing any kind of difficulty.

In general, it can be said that the adaptable modules 100 to make a railing according to the invention, are suitable for numerous implementation variants. These may depend not only on aspects concerning the individual components of the system, such as the coupling mechanisms between the various elements, or on the use of additional elements, in addition to the essential ones that have been indicated in this description, but also on the possibility of using a large variety of materials. In fact, the materials do not constitute characterizing prerogatives of the invention which, moreover, adapts to the construction of railings with very different strength requirements: therefore, to make each individual part of the system, many materials can be used indeed, ranging from metallic materials to plastic ones, up to conceive railings made of different materials.

Depending on the implementation cases, these variants can offer further advantages compared to those already mentioned, and can be implemented by the man skilled in the art without thereby departing from the scope of the invention as can be understood from the present description and from the attached claims.

Therefore, each variant of a railing adaptable to any terrain and any path of fencing that presents the essential characteristics indicated in the main claim, must be considered a different implementation of the same invention, without thereby altering the principles and the inventive nature which inspired the invention itself.

Furthermore, the invention can be partially implemented, just as it can be enriched with additional accessory elements. It does not escape, in fact, that the railing according to the invention can be enriched with devices specifically oriented to the implementation of particular installation methodologies.

Or, the adaptable modules 100 to make a railing according to the invention may evolve towards a greater emphasis for the automation of installation and/or maintenance, and it is possible to arrive at the definition of methods likely to become highly automated processes.

Therefore, the invention lends itself to incorporating and supporting further evolutionary efforts capable of improving the railing as a whole, but also of defining increasingly efficient installation and/or maintenance methodologies. Such developments, if not included in the present description, may be subject of further patent applications associated with the present invention.

The invention claimed is:

1. A modular railing comprising a plurality of modules (100) connected to each other, wherein each module (100) is an element of railing, comprising:

a. at least one supporting post (110) located at one end of said railing module (100), and suitable for being attached to the ground;

b. an upper horizontal bar (120) which connects said supporting post (110) to another supporting post (210) belonging to the adjacent module, and said upper horizontal bar (120) is coupled to said two supporting posts (110, 210) near their upper end;

c. a lower horizontal bar (130) which connects said supporting post (110) to said another supporting post (210) belonging to the adjacent module, and said lower horizontal bar (120) is coupled to said two supporting posts (110, 210) near their base;

d. a plurality of vertical rods (140) which connect said upper (120) and lower (130) horizontal bars;

and wherein said each module (100) is characterized in that:

each module (100) is identical to the modules (100) to which it is connected, regardless of the slope and the direction of installation;

said upper horizontal bar (120) comprises a couple of substantially constant section profiled elements, an upper profiled element (121) and a lower profiled element (122), wherein:

said upper profiled element (121) has a face facing upwards whose surface is substantially smooth, said lower profiled element (122) has a face facing downward in which there are a plurality of holes;

said lower horizontal bar (130) comprises at least one upper profiled element (132) with a substantially constant section, which has a face facing upwards in which there are a plurality of holes;

said plurality of vertical rods (140) are coupled to said upper (120) and lower (130) horizontal bars, so that the upper end of each of said vertical rods (140) is inserted into one of the plurality of holes present on said lower profiled element (122) of said upper horizontal bar (120), and said coupling has the prerogative not to form an interlocking joint and to allow said each vertical rod (140) to vary the angle it forms with said upper horizontal bar (120) so that said each vertical rod (140) maintains the verticality even if said upper horizontal bar (120) is not horizontally installed, and wherein the lower end of each of said vertical rods (140) is inserted into one of the plurality of holes present on said upper profiled element (132) of said lower horizontal bar (130), and said coupling has the prerogative not to form an interlocking joint and to allow said each vertical rod (140) to vary the angle it forms with said lower horizontal bar (130) so that said each vertical rod (140) maintains the verticality even if said lower horizontal bar (130) is not horizontally installed;

wand wherein said upper horizontal bar (120) and said lower horizontal bar (130) are connected at their ends to said two supporting posts (110, 210) by means of a constraint which allows to provide an adjustable angle with one degree of freedom;

said supporting post (110) comprises at least two longitudinal profiled elements:

an external longitudinal profiled element (111) arranged to be fixed vertically to the ground, and an internal longitudinal profiled element (112) arranged to be coupled with said external longitudinal profiled element (111) so that said internal longitudinal profiled element (112) can rotate around its own longitudinal axis before being fixed in a definitive installation position, and once their coupling has been completed, said internal and external profiled elements (111, 112) are coupled side by side and parallel.

2. The modular railing comprising a plurality of modules (100) according to claim 1, wherein said lower horizontal bar (130) also comprises a lower profiled element (131) suitable for coupling with said upper profiled element (132) so as to form a single body.

3. The modular railing comprising a plurality of modules (100) according to claim 2, wherein, following the coupling of said upper (121, 132) and lower (122, 131) profiled elements of said upper and lower horizontal bars (120 and 130), inside said upper and lower horizontal bars (120, 130) a hollow space is formed, inside which there is a filling element (135) made with a compressible material which is in contact with the top and bottom ends of said vertical rods (140), with the function of counteracting vibrations of said vertical rods (140).

4. The modular railing comprising a plurality of modules (100) according to claim 2, wherein, following the coupling of said upper (121, 132) and lower (122, 131) profiled elements of said upper and lower horizontal bars (120, 130), inside said upper and lower horizontal bars (120, 130) a hollow space is formed, in which the ends of said vertical rods (140) are housed, when they are assembled in said modules (100), and at least one of these lower and upper ends (142) of said vertical rods (140), which are housed inside said hollow space, is coupled to a damper element (136) made of a compressible material, with the function of counteracting the vibrations of the vertical rod (140) to which said at least one end belongs.

5. The modular railing comprising a plurality of modules (100) according to claim 1, wherein said vertical rods (140) in their central part, which is comprised between said lower horizontal bar (130) and said upper horizontal bar (120), have a constant section.

6. The modular railing comprising a plurality of modules (100) according to claim 5, wherein said constant section of said vertical rods (140) has the shape of a straight slit, corresponding to a shape of said vertical rods are approximable with that of a flat and thin bar.

7. The modular railing comprising a plurality of modules (100) according to claim 5, wherein said constant section of said vertical rods (140) has a "V" shape, corresponding to a shape of said vertical rods which are approximable with that of a bar flat and thin longitudinally folded.

* * * * *